US009193147B2

(12) United States Patent
Weber

(10) Patent No.: US 9,193,147 B2
(45) Date of Patent: Nov. 24, 2015

(54) FOIL TRANSFER DEVICE

(71) Applicant: HEIDELBERGER DRUCKMASCHINEN AG, Heidelberg (DE)

(72) Inventor: Alexander Weber, Weinheim (DE)

(73) Assignee: HEIDELBERGER DRUCKMASCHINEN AG, Heidelberg (DE)

( * ) Notice: Subject to any disclaimer, the term of this patent is extended or adjusted under 35 U.S.C. 154(b) by 0 days.

(21) Appl. No.: 14/218,241

(22) Filed: Mar. 18, 2014

(65) Prior Publication Data

US 2014/0283696 A1 Sep. 25, 2014

(30) Foreign Application Priority Data

Mar. 20, 2013 (DE) ..... 10 2013 004 766

(51) Int. Cl.
*B41F 16/00* (2006.01)
*B41F 19/00* (2006.01)

(52) U.S. Cl.
CPC ..... *B41F 19/005* (2013.01); *B41F 16/006* (2013.01); *B41F 19/001* (2013.01)

(58) Field of Classification Search
CPC ..... B41F 19/005; B41F 16/006; B41F 16/00; B41F 16/0006; B41F 16/02; B41M 5/03; B41M 5/0358
See application file for complete search history.

(56) References Cited

U.S. PATENT DOCUMENTS

| | | | | |
|---|---|---|---|---|
| 4,057,864 | A | 11/1977 | Wild | |
| 4,060,382 | A * | 11/1977 | Vertegaal | 8/444 |
| 4,244,465 | A * | 1/1981 | Hishikawa et al. | 198/691 |
| 4,269,334 | A * | 5/1981 | Chodosh | 223/28 |
| 5,532,722 | A | 7/1996 | Namiki et al. | |
| 5,611,272 | A | 3/1997 | Steuer | |
| 8,206,527 | B2 | 6/2012 | Strunk | |
| 2006/0017942 | A1 * | 1/2006 | Clark | 358/1.4 |
| 2007/0163455 | A1 * | 7/2007 | Eitel et al. | 101/216 |
| 2009/0294038 | A1 | 12/2009 | Jurkewitz et al. | |

FOREIGN PATENT DOCUMENTS

| | | | |
|---|---|---|---|
| DE | 2530218 | A1 | 1/1976 |
| DE | 9420707 | U1 | 2/1995 |
| DE | 69401669 | T2 | 5/1997 |

* cited by examiner

*Primary Examiner* — Daniel J Colilla
*Assistant Examiner* — Leo T Hinze
(74) *Attorney, Agent, or Firm* — Laurence Greenberg; Werner Stemer; Ralph Locher

(57) ABSTRACT

A foil transfer device includes a transport cylinder for transporting a printed sheet, a pressure cylinder for pressing a web of transfer foil against the transported printed sheet, and a support belt for supporting the web of transfer foil. The support belt passes through a transfer nip jointly formed by the transport cylinder and the pressure cylinder.

9 Claims, 1 Drawing Sheet

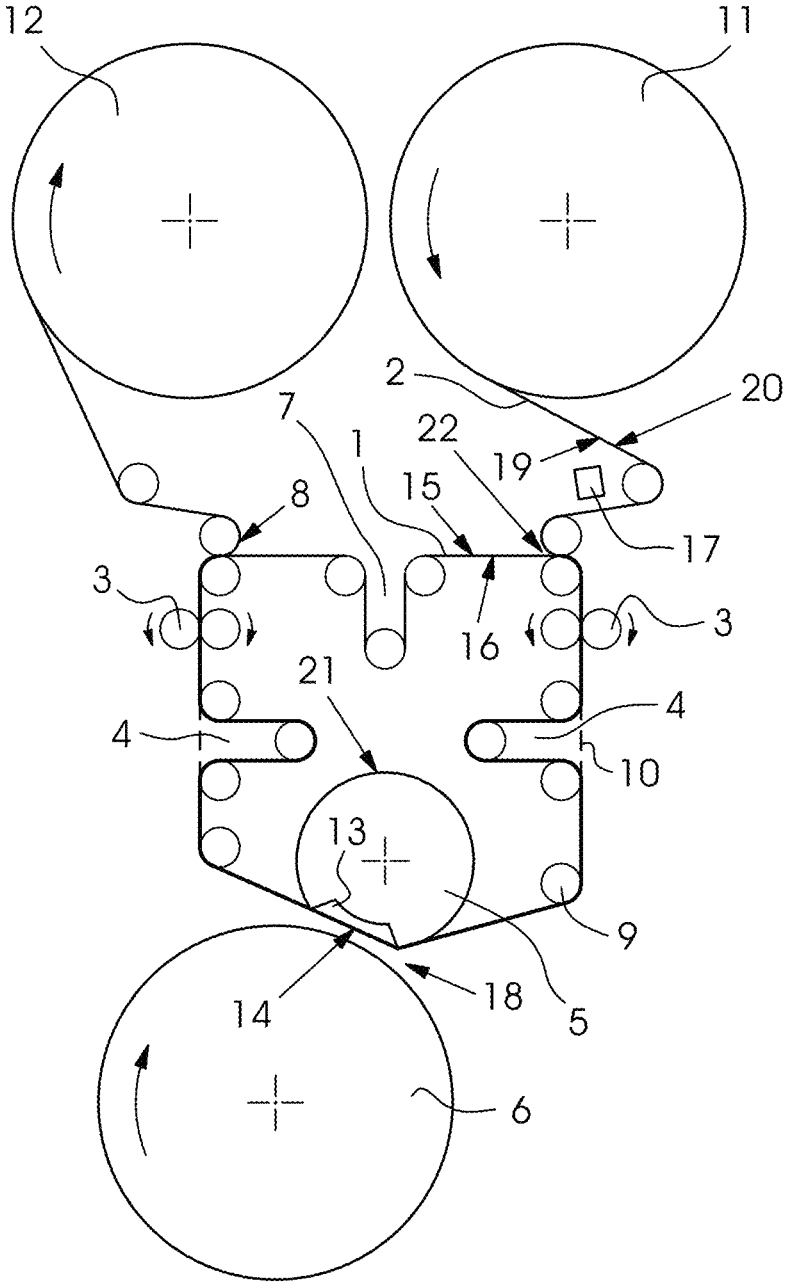
12
11
2
20
7
1
22
19
15
8
17
3
16
3
21
4
4
10
13
9
14
18
5
6

FOIL TRANSFER DEVICE

CROSS-REFERENCE TO RELATED APPLICATION

This application claims the priority, under 35 U.S.C. §119, of German Patent Application DE 10 2013 004 766.8, filed Mar. 20, 2013; the prior application is herewith incorporated by reference in its entirety.

BACKGROUND OF THE INVENTION

Field of the Invention

The present invention relates to a foil transfer device.

Foil transfer devices include hot-foil stamping devices (as described in German Utility Model DE 94 20 707 U1, corresponding to U.S. Pat. No. 5,611,272, for example) and cold-foil transfer devices (as described in U.S. Pat. No. 8,206,527 B4, for example).

In foil transfer devices, the tension of the web of transfer foil needs to be kept constant.

U.S. Patent Application Publication No. 2009/294038 A1 describes a cold-foil transfer device wherein the tension of the web of transfer foil in a transfer nip is affected by a cylinder gap of a transfer cylinder. In order to reduce web tension changes, guide elements upstream and downstream of the transfer nip are moved asynchronously.

SUMMARY OF THE INVENTION

It is accordingly an object of the invention to provide a foil transfer device, which overcomes the hereinafore-mentioned disadvantages of the heretofore-known devices of this general type.

With the foregoing and other objects in view there is provided, in accordance with the invention, a foil transfer device, comprising a transport cylinder for transporting a printed sheet or signature, a pressure cylinder for pressing the web of transfer foil against the printed sheet that is being transported, and a support belt for supporting the web of transfer foil. The support belt passes through a transfer nip formed by the transport cylinder and the pressure cylinder together.

The advantages of the foil transfer device of the invention are:

The support belt damps peak web tensions in the web of transfer foil. This feature is particularly advantageous if the pressure cylinder has a cylinder gap that causes such peak web tensions.

The support belt prevents the web of transfer foil from being overstretched and avoids cross tears in the web. This is particularly advantageous if a very thin transfer foil (having a thickness of 15 micrometers or less) is being processed, which would otherwise be prone to such damages.

The result is increased production stability.

In accordance with another feature of the invention that is advantageous in terms of a synchronous running of the support belt and the web of transfer foil, the support belt is an endless belt. A joint location such as a gluing or welding location may be present for connecting the belt ends of the endless belt.

In accordance with a further feature of the invention that is advantageous in terms of a synchronous running of the joint location of the revolving support belt and a cylinder gap of the rotating pressure cylinder, the belt length of the support belt is an integer multiple of the circumferential length of the pressure cylinder. This ensures that the joint location is always located opposite the cylinder gap when the joint location passes the transfer nip. The joint location and the transfer nip meet periodically or in a phase-synchronous way.

In accordance with an added feature of the invention that is advantageous in terms of the support belt being partly wrapped around the pressure cylinder, the pressure cylinder is disposed inside a path of revolution of the endless belt.

In accordance with an additional feature of the invention that is advantageous in terms of improving the release behavior of the web of transfer foil in the transfer nip, the belt or web tension of the support belt is at least as high as the web tension of the web of transfer foil and preferably even higher than the web tension of the web of transfer foil.

In accordance with yet another feature of the invention that is advantageous in terms of a constant web tension in the support belt, a belt or web tension control device for the support belt is provided to provide closed-loop control of the belt or web tension in the support belt.

In accordance with yet a further feature of the invention that is advantageous in terms of avoiding a web tension increase as a result of relative movements between the pressure cylinder and the support belt, the interior or reverse side of the support belt, i.e. the side facing the circumferential surface of the pressure cylinder, is provided with a slide surface in such a way that a common friction coefficient between the circumferential surface and the slide surface in contact with the former is smaller than a common friction coefficient between the circumferential surface and the outer (front) side of the support belt, i.e. the side facing away from the circumferential surface and not in contact with the latter. This feature is particularly advantageous if the pressure cylinder is a rubber blanket cylinder and the circumferential surface is formed by a rubber blanket mounted to the pressure cylinder. In this context, the reverse side of the support belt is formed of a material that has better sliding properties on rubber than the material that constitutes the front side of the support belt. The possible slip between the circumferential surface of the pressure cylinder and the reverse belt side is greater than a hypothetical slip would be between the circumferential surface and the front belt side. This is particularly advantageous if the foil transfer device includes a timing device for timing the common advance of the support belt and of the web of transfer foil, an aspect which is advantageous in view of an optimum use of transfer foil material since it contributes to saving transfer foil. The timing device causes the advance to be discontinuous at least in the transfer nip.

In accordance with yet an added feature of the invention that is advantageous in terms of dispensing with the mounted rubber blanket, the support belt itself is a rubber blanket belt. The support belt is multifunctional. It is used to support the web of transfer foil and it is used as a rubber blanket for generating the correct pressing force in the transfer nip.

The support belt may have a multi-layer construction, with a layer forming the reverse side made of a different material than a layer forming the front side. The sliding properties of the material forming the reverse side may be better than those of the material forming the front side. For instance, the layer forming the front side may be a rubber layer and the layer forming the reverse side may be a textile layer. This is particularly advantageous if the circumferential surface of the pressure cylinder is made of chromium since the textile material slides very well on chromium.

In accordance with yet an additional feature of the invention that is advantageous in terms of forming a double web out of the support belt together with the web of transfer foil, an adhesion enhancement device is provided to improve adhesion of the web of transfer foil on the support belt. The adhesion is artificially enhanced beyond its natural measure. This avoids disruptive relative movements between the web of transfer foil and the support belt. Temporary adhesion of the web of transfer foil on the support belt is achieved in a section of contact formed by the two together, with the adhesion being sufficiently strong to prevent the web of transfer foil from shifting on the support belt.

The adhesive force may be increased by temporarily gluing the support belt and the web of transfer foil together in sections, with the adhesion enhancement device being a glue application device that applies glue to the support belt or to the web of transfer foil. However, glue as an additional auxiliary material is necessary for this purpose.

In accordance with a concomitant feature of the invention that is advantageous in terms of avoiding the consumption of an additional auxiliary material, the adhesion enhancement device is a magnetic device or, preferably, an electrostatic device. The support belt and/or the web of transfer foil may be charged electrostatically or as counter poles by the electrostatic device or ionization device, causing the two to electrostatically adhere to each other.

If the two elements in question—i.e. the support belt and the web of transfer foil—are identically charged, i.e. are homopolar before the section of mutual contact is established, the electrostatic device may be a de-electrification device for discharging one of the two elements. The discharging causes two mutually different charge levels of the two elements to be established, resulting in an artificially enhanced adhesive force.

Other features which are considered as characteristic for the invention are set forth in the appended claims.

Although the invention is illustrated and described herein as embodied in a foil transfer device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE SEVERAL VIEWS OF THE DRAWING

The FIGURE of the drawing is a vertical-sectional view of a foil transfer device of a printing press having multiple printing units for printing on sheets in an offset printing process.

DETAILED DESCRIPTION OF THE INVENTION

Referring now in detail to the single FIGURE of the drawing, there is seen a web of transfer foil 2 which runs from a supply reel 11 to a collecting reel 12. The web of transfer foil 2 has multiple layers and includes a carrier foil 19 and a transfer foil 20 located on the carrier foil 19. A pressure cylinder 5 and a transport cylinder 6 together form a transfer nip 18. The transport cylinder 6 transports the sheets and the pressure cylinder 5 presses the web of transfer foil 2 against the sheets. The transport cylinder 6 acts as an impression cylinder.

Foil pieces of the transfer foil 20 are removed from the carrier foil 19 and transferred to the sheets in the transfer nip 18. In order for the foil pieces intended for transfer to be torn out of the transfer foil 20 and to adhere to the sheets, the latter are coated with glue in accordance with a printing image before the sheets enter the transfer nip 18. No heat is applied for the transfer, i.e. it is a cold-foil transfer. An unused portion of the web of transfer foil 2 is wound onto the supply reel 11 and a used portion out of which pieces of foil have been torn is wound onto the collecting reel 12.

A support belt 1 passes through the transfer nip 18 together with the web of transfer foil 2, in such a way that the support belt 1 faces the pressure cylinder 5 and the web of transfer foil 2 faces the transport cylinder 6. The support belt 1 is more stable than the web of transfer foil 2. The fact that the support belt 1 is thicker than the web of transfer foil contributes to the greater stability of the support belt 1 compared to the web of transfer foil 2. The thickness of the belt exceeds 0.1 mm and preferably is greater than 0.1 mm and less than 1 mm, amounting to at least 0.2 mm, for example. In order to form an endless belt, the ends of the support belt 1 are joined at a joint location 14. A cylinder gap 13 on a circumferential side of the pressure cylinder 5 may be a mounting gap in which a mounting device for mounting a rubber blanket 21 to the pressure cylinder 5 is provided.

The pressure cylinder 5 has bearer rings with a bearer ring height which corresponds to the thickness of the packing or cover. A depth of a cylinder undercut of the pressure cylinder 5 is dimensioned accordingly. A thickness or height of the packing or cover is usually defined by a blanket thickness of the rubber blanket 21 and a packing thickness of underlying packing sheets. In the device described herein, the packing or cover height or thickness is additionally defined by the belt thickness of the support belt 1, the total of blanket thickness, packing thickness and belt thickness and the cylinder undercut being dimensionally identical.

The support belt 1 supports the web of transfer foil 2 within a common path section starting at an entering and joining nip 22 and terminating at an exit and separating nip 8. Each of these nips 22, 8 is formed by a pair of rollers.

In the joining nip 22 the web of transfer foil 2 and the support belt 1 are combined in that the web of transfer foil 2 is placed upon the support belt 1 to advance with the latter in a sandwich configuration. The web of transfer foil 2 enters the joining nip 22 over one roller of the roller pair forming the joining nip 22, and the support belt 1 enters that nip over the other roller of the roller pair.

An adhesion enhancement device 17 is provided in a path of one of the two elements to be joined—i.e. the web of transfer foil 2 and the support belt 1—in a path section upstream of the joining nip 22 as viewed in the direction of transport. In the illustrated example, the adhesion enhancement device 17 is an electrostatic device acting on the web of transfer foil 2 in a path section thereof located upstream of the joining nip 22 to electrostatically charge the web of transfer foil 2 in order for it to adhere more firmly to the support belt 1.

In the separating nip 8, the sandwich configuration is dissolved by separating the web of transfer foil 2 from the support belt 1 in order for the two to continue separately. The web of transfer foil 2 exits the separating nip 8 over one roller of the roller pair forming the separating nip 8 and the support belt 1 exits the nip 8 over the other roller.

The support belt 1 has a front side 15 and a reverse side 16. The two sides 15, 16 differ from each other in their sliding properties. This is ensured in that the two belt sides have material properties that differ accordingly. The material properties may differ from each other in terms of material and/or in the surface roughness. The low-friction reverse side 16 slides more easily on the circumferential surface of the pressure cylinder 5 formed by the rubber blanket 21 than the front side 15 would if the latter was in contact with the circumferential surface, which is not the case, however. This allows slip between the circumferential surface and the reverse side 16. This slip of the support belt 1 as it is wrapped around the circumferential surface is expedient in certain situations to avoid peak web tensions.

A factor contributing to a greater stability of the support belt 1 as compared to the web of transfer foil 2 is that the longitudinal belt or web tension in the support belt 1 is greater than the longitudinal web tension in the web of transfer foil 2.

The web tension of the support belt 1 is controlled by a web tension control device 7 embodied as a dancer roller configuration. The web tension control device 7 may be provided in addition to a potentially existing web tension control device controlling the web tension of the web of transfer foil 2. The rollers of the web tension control device 7 of the support belt 1 only guide the support belt 1 and not the web of transfer foil 2.

The support belt 1 or its path of revolution is subdivided into a plurality of imaginary main sections and subsections by components contacting the support belt 1, such as deflection rollers 9. A first main section extends from the joining nip 22 to the separating nip 8 and a second main section extends from the separating nip 8 to the joining nip 22. The entire second main section is exclusively part of the path of the support belt 1 and not of the path of the web of transfer foil 2. The web tension control device or controller 7 is disposed within the second main section.

The support belt 1 and the web of transfer foil 2 run jointly in double-layered configuration along the entire first main section. The transfer nip 18 is located in the first main section, separating the first main section into a first subsection and a second subsection. The first subsection extends from the joining nip 22 to the transfer nip 18. The second subsection extends from the transfer nip 18 to the separating nip 8. In both subsections, a respective pulling device 3 and a respective timing device 4 are provided.

The two pulling devices 3 are each formed by a respective roller pair. Both rollers of each roller pair are driven to rotate in such a way that the two rollers have the same circumferential speed. This ensures a common advance of the support belt 1 and the web of transfer foil 2 at a synchronous speed. The two rollers of the respective roller pair may be relatively coupled to each other, for instance by a pair of gears.

Each of the two timing devices 4 is embodied as a dancer roller configuration. In the timing process, a horizontal linear movement of the dancer roller of the one timing device 4 and a horizontal linear movement of the dancer roller of the other timing device 4 are carried out in synchronism, in the same direction, and are of equal length. The timing devices 4 allow the common advance of the support belt 1 and the web of transfer foil 2 to temporarily reverse direction in the region of the transfer nip 18.

The timing devices 4 do not have to be present in all applications. If no timing devices 4 are provided, the support belt 1 and the web of transfer foil 2 supported thereon have a shortened web path 10, which is indicated in the drawing by phantom lines.

The invention claimed is:

1. A foil transfer device, comprising:

a transport cylinder configured to transport a printed sheet;

a supply reel having a web of transfer foil, said web of transfer foil having multiple layers;

a pressure cylinder configured to press said web of transfer foil against the transported printed sheet, said pressure cylinder having a circumferential length and a cylinder gap;

said transport cylinder and said pressure cylinder jointly forming a transfer nip; and a support belt passing through said transfer nip and configured to support said web of transfer foil, said support belt having belt ends interconnected at a joint location forming an endless belt, said support belt having a belt length being an integer multiple of said circumferential length of said pressure cylinder causing said joint location to always be located opposite a cylinder gap of said pressure cylinder when said joint location passes said transfer nip.

2. The foil transfer device according to claim 1, wherein said support belt is an endless belt having a path of revolution, and said pressure cylinder is disposed within said path of revolution.

3. The foil transfer device according to claim 1, wherein said support belt has a belt tension or web tension being at least as high as a web tension of said web of transfer foil.

4. The foil transfer device according to claim 3, which further comprises a belt or web tension control device configured to control the web tension in said support belt.

5. The foil transfer device according to claim 1, wherein:

said pressure cylinder has a circumferential surface;

said support belt has a front side and a reverse side;

said reverse side faces said circumferential surface of said pressure cylinder and has a sliding surface; and a common coefficient of friction between said circumferential surface and said sliding surface contacting said circumferential surface is smaller than a common coefficient of friction of said circumferential surface and said front side of said support belt.

6. The foil transfer device according to claim 1, wherein said support belt is a rubber blanket belt.

7. The foil transfer device according to claim 1, which further comprises an adhesion enhancement device configured to increase adhesion of the web of transfer foil on said support belt.

8. The foil transfer device according to claim 7, wherein said adhesion enhancement device is an electrostatic device.

9. A foil transfer device, comprising:

a transport cylinder configured to transport a printed sheet;

a pressure cylinder configured to press a web of transfer foil against the transported printed sheet, said pressure cylinder having a circumferential length and a cylinder gap;

said transport cylinder and said pressure cylinder jointly forming a transfer nip; and a support belt passing through said transfer nip and configured to support said web of transfer foil, said support belt having belt ends interconnected at a joint location forming an endless belt, said support belt having a belt length being an integer multiple of said circumferential length of said pressure cylinder causing said joint location to always be located opposite a cylinder gap of said pressure cylinder when said joint location passes said transfer nip.

* * * * *